United States Patent [19]

Gratzmuller

[11] 4,243,856

[45] Jan. 6, 1981

[54] PISTON-TYPE HYDROPNEUMATIC ACCUMULATOR EQUIPPED WITH A GAS SHORTAGE DETECTION DEVICE

[76] Inventor: Jean L. Gratzmuller, 66 Boulevard Maurice Barrés, 92200 Neuilly sur Seine, France

[21] Appl. No.: 12,447

[22] Filed: Feb. 15, 1979

[30] Foreign Application Priority Data

Feb. 27, 1978 [FR] France ..... 78 05511

[51] Int. Cl.[3] ..... H01H 35/38

[52] U.S. Cl. ..... 200/81.5; 200/84 C; 200/81 R; 200/82 E; 73/745; 340/605; 60/535

[58] Field of Search ..... 200/81 R, 82 R, 82 C, 200/82 E, 61.2, 84 R, 84 B, 84 C, 81.5, 302, 330, 331, 332; 340/605, 618, 623, 624, 59; 73/745, 49.1, 49.2, 49.3; 60/534, 535, 545; 92/5 R

[56] References Cited

U.S. PATENT DOCUMENTS

| | | | |
|---|---|---|---|
| 3,671,695 | 6/1972 | Wing | 340/59 |
| 3,935,410 | 1/1976 | Howard | 200/332 |
| 3,953,845 | 4/1976 | Kress | 340/59 |
| 4,166,936 | 9/1979 | Tice | 200/82 E |

*Primary Examiner*—Gerald P. Tolin

*Attorney, Agent, or Firm*—Cantor and Singer

[57] ABSTRACT

In the gas shortage detection device of a piston-type hydropneumatic accumulator, a control rod slidably mounted in the cylinder head on the gas side is displaced under the action of the thrust exerted by the piston when this latter comes closer to the cylinder head than a predetermined distance. A flexible motion-reversal coupling element such as an inextensible cord which works in traction and has a predetermined dead range of travel is placed between the piston and the sliding rod.

Correct performance of the detection device can thus be checked by partial draining of the oil compartment, the detection device being triggered into operation when the piston comes close to the bottom end of the cylinder.

7 Claims, 3 Drawing Figures

PISTON-TYPE HYDROPNEUMATIC ACCUMULATOR EQUIPPED WITH A GAS SHORTAGE DETECTION DEVICE

The present invention relates to piston-operated hydropneumatic accumulators, especially those equipped with gas shortage warning devices and employed in oleopneumatic control systems for electric circuit-breakers.

Oleopneumatic control is not a novel concept since the first high-voltage circuit-breakers of this type came into use in 1952.

An immediately available reserve supply of hydraulic power is stored in one or a number of hydropneumatic accumulators in the form of a compressed gas cushion which is permanently confined within the gas chamber of the accumulator and pre-pressurized to a value which has been determined beforehand.

The successful application of this technique was based on a type of accumulator which conforms to a high standard of reliability, which is inflated at works and is capable of retaining its gas charge without loss over a period of many years.

It is known that a piston-operated hydropneumatic accumulator is essentially constituted by a cylinder closed by two ends and divided by a free piston into two compartments, one of which contains a gas under pressure whilst the other contains a liquid usually consisting of oil. Devices of this type serve to store and supply oil under pressure for the operation and control of actuating units such as jacks, the accumulator being recharged with oil by means of a pump according to its consumption.

The first condition to be satisfied in these devices is that the metals constituting the basic elements must offer perfect leak-tightness. However, such a result cannot be achieved in practice as readily as may at first appear to be the case.

A further condition to be satisfied is that the sliding seal must be so designed as to ensure a very high standard of leak-tightness between the piston and the cylinder and the same applies to the stationary seal between the cover and the cylinder. These problems have both been solved.

In regard to the moving seal, the solution was to subject a seal of elastomer to a continuous axial elastic force resulting in a radial deformation which permanently maintains the seal applied against the cylinder wall under a pressure of higher value than the pressure to be contained (French Pat. No. 1,024,868 of Sept. 23rd, 1950 in the name of the same inventor). This accordingly makes it possible to overcome the disadvantages arising from the characteristic which is common to all elastomers, namely that of acquiring permanent deformation in time when they are subjected to a continuous effort; thus it is also possible in the event of temperature variations to compensate for the fact that their coefficient of expansion is higher than that of metals.

In regard to the actual fabrication of the sliding seal, a number of patents by the same inventor have provided very effective solutions.

A perfect solution to the problem of the stationary seal between the cylinder and the stationary end-wall has been provided by the pressure seal of the autoclave type (disclosed in French Pat. No. 1,042,201 of Sept. 14th, 1951 in the name of the same inventor), said stationary seal being thus subjected to a pressure which is several times higher in value than the pressure of gas to be contained, irrespective of deformations. No improvement has been made in this technique which has proved wholly satisfactory from the very first applications, which is an exceptional case in this technology.

All the oleopneumatic accumulators currently employed in circuit-breaker control systems are derived from these basic principles. A number of detail variants have been claimed but more on commercial grounds than on real technological grounds.

At the time of construction or start-up of these devices, the gas compartment is filled with an inert gas under a predetermined pressure or so-called "pre-inflation pressure". This elastic gas cushion then ensures that the liquid is maintained under pressure and constitutes the elastic reserve of energy which the apparatus is capable of supplying.

Components which are liable to give rise to gas leakages have thus been reduced to the minimum number of three metallic elements (namely the cylinder, the piston and the cover) and two seals (namely a sliding piston seal and an autoclave cover seal) and the initial-filling orifice for which it has been possible to find a suitable solution.

At the present time, over 100,000 oleopneumatic breaker-control accumulators having the above-mentioned characteristics have been put into service throughout the world and given complete satisfaction to users.

A steady progression can be noted, however, in the requirements laid down by users. In particular, the current development of so-called "maintenance-free" high-voltage circuit-breakers has established a need for accumulators which guarantee freedom from gas leakage over periods of five years, ten years and now twenty years.

It proves feasible to achieve this result in practice by employing a neutral gas such as nitrogen in the accumulator at pressures up to 400 bar (kg/cm$^2$) and helium at higher pressures (French Pat. No. 2,076,812 of Jan. 20th, 1970 in the name of the same inventor). This prevents any corrosion of metallic parts and prevents aging of the elastomers which constitute the seals as well as the oil which is suitably filtered.

When any operation for opening or closing a high-voltage circuit-breaker has been initiated, the operation must proceed to completion, otherwise a major accident would occur and result at least in the destruction of the circuit-breaker.

Since the operating energy is delivered by the accumulator, the reserve supply of gas must consequently be sufficient.

Since no technique is completely faultless, users have been led to request the adoption of a system which provides a warning in the event of occurrence of a fault condition in an oleopneumatic accumulator, namely a condition which is indicated by an abnormal position of the piston in respect of a given pressure and results in a loss of gas.

In practice, it is primarily important to know the position of the free piston when it comes close to one of its normal end-of-travel positions. In other words, if the piston passes beyond a predetermined limit towards the end of the gas compartment, this means that a loss of "pre-inflation" has taken place (and therefore that it is necessary either to repair a leak or to "re-inflate" the accumulator). On the other hand, if the piston comes too close to the bottom of the oil compartment, this means that there is an oil shortage (resulting from either leakage or abnormal consumption).

Monitoring systems have already been proposed for producing an alarm signal when the piston comes too close to one of the cylinder ends and especially when the piston comes too close to the end of the gas compartment. In some applications of hydropneumatic accumulators such as the supply of hydraulic control systems for electric circuit-breakers, users even require that a safety system of this type for monitoring a gas shortage should be incorporated in the accumulator.

Among the known types of control systems which have been in use up to the present time, one of the most straightforward designs comprises an emergent sliding rod which passes through the cylinder end of the gas side and projects into the interior of the gas compartment. When the piston comes closer to the end than a predetermined distance, the piston exerts a thrust on the rod and the external end of said rod triggers an alarm system or actuates, for example, an electric switch which closes an alarm circuit.

This emergent rod solution calls for additional sealing means and is a potential source of gas leakage.

It therefore proved desirable to design a system which would not be liable to cause any impairment of leak-tightness of the accumulator. The best solution accordingly consisted in placing a permanent magnet within the accumulator; the magnet which was actuated by the moving piston in turn produced magnetic action on an electric contact located outside the accumulator when the piston for the normal oil pressure comes abnormally close to the cylinder cover (French Pat. No. 2,236,098 of July 4th, 1973 in the name of the same inventor).

By virtue of the facts that, in the above-mentioned device, the cylinder end on the gas side is formed of non-magnetic metal, that the permanent magnet is capable of moving within a blind-end bore of said cylinder end which opens only into the gas compartment, and that the switch is housed within a second blind-end bore which is adjacent to the first but opens only to the exterior, the result thereby achieved is to dispense with any need for additional sealing means and consequently to forestall any danger of gas leakage caused by the monitoring device itself.

There are therefore a number of known expedients for warning the user of a gas shortage in an accumulator. In the majority of instances, such expedients consist in actuating the piston or a member rigidly fixed to the piston by exerting a thrust on a moving element which in turn actuates a gas shortage warning system when displaced by the thrust of the piston.

Although these different design solutions achieve the desired degree of safety, especially the solution described in the patent cited earlier, they are all attended, however, by a certain number of disadvantages.

In fact, two new problems have arisen:

(1) by reason of the fragility of the electrical control circuit and circuit components, the possibility of checking the good operation of the warning system;

(2) in high-power and high-voltage circuit-breakers comprising a plurality of oleopneumatic accumulators, the possibility of periodically checking the individual "pre-inflation" pressure of each accumulator without any need for disassembly.

As has been noted, well-designed hydropneumatic accumulators of the types which are currently in use offer excellent gas-tightness and are capable of remaining either in storage or in service for a number of years without any need for "re-inflation" of the gas compartment. This means that the gas shortage detection and monitoring devices referred-to above are required to operate only very rarely and in fact in very exceptional instances although their safety function is of primary importance.

It is for this reason that users find it desirable to have the possibility of periodically checking the good operation of the monitoring device and especially to carry out a check when putting an installation into service, for example an installation for the hydraulic control of circuit-breakers.

A simple means of checking would consist in charging the accumulator with oil at a sufficient pressure to bring the free piston close to the cylinder end on the gas side until the monitoring device is triggered into operation. In practice, however, this would make it necessary to increase the pressure within the accumulator to a value above the normal service pressure, namely a value which would come close to the ultimate pressures prescribed for safety testing of the accumulator, which is both strictly prohibited and dangerous.

In order to circumvent this drawback, it would clearly be possible at the outset to carry out partial "deflation" of the gas compartment in order that the free piston which is displaced by the oil should actuate the monitoring device without entailing the need for excessively high pressures.

On completion of the checking operation, it would be necessary in this case, however, to re-inflate the accumulator with gas at the normal pressure. This operation must be performed by specialists and preferably at works by the manufacturer of the accumulator.

The aim of the present invention is to overcome the disadvantages mentioned above and to enable the user to check the good operation of the gas shortage detection and warning device when this latter is put into service and even subsequently at intervals.

The invention relates to a hydropneumatic accumulator of the type mentioned above and comprising a gas shortage warning system controlled by a movable member displaced under the action of the thrust exerted by the piston when this latter comes closer to the cylinder end on the gas side than a predetermined distance. Said accumulator is distinguished by the fact that motion-reversal coupling means working in traction are interposed between the piston and the movable member and that said coupling means have a dead range of travel of predetermined value. Thus said movable member is also displaced in the same direction as when it is displaced directly under the action of the thrust exerted by the piston and therefore in the direction of operation of the warning system when the piston moves away from the cylinder end on the gas side beyond a predetermined distance.

In order to check the good operation of the gas shortage monitoring system, it is only necessary to reduce the oil pressure within the accumulator until the free piston comes sufficiently close to the bottom of the oil compartment to ensure that the aforesaid coupling means displace the movable member which in turn actuates the warning system.

The device in accordance with the invention has a further advantage in that, during the checking operation, all the elements of the monitoring system operate in the same manner and in the same direction as when said monitoring system comes into operation solely in order to indicate a loss of gas.

Once the checking operation has been completed, it only remains to recharge the accumulator with oil to the normal pressure, which is a very straightforward operation since provision is always made for an oil recharge pump in the hydraulic control installation.

It should finally be noted that, without introducing any further complication, the device in accordance with the invention is also capable of indicating, not only a gas shortage, but also any abnormal movement of approach of the piston towards the cylinder end on the oil compartment side since such a movement of approach would mean that there is a shortage of oil (or abnormally high oil consumption).

This makes it possible to check the respective state of "pre-inflation" of a number of individual accumulators mounted in parallel in the same installation. In fact, by reducing the oil pressure within the installation, the pistons of all the accumulators will come into contact with their cylinder ends on the oil side and the warning systems of all the accumulators must come into operation if they are in good working order, thus providing the answer to the first problem mentioned above.

By progressively increasing the oil pressure within the installation, the warning system of each accumulator will cut-off when the oil pressure finally exceeds the gas "pre-inflation" pressure of said accumulator.

When the two successive operations described in the foregoing have been completed, it will thus have been possible to observe the good operation of the warning system of each accumulator and to measure its "pre-inflation" pressure without any need for disassembly and without introducing any excess oil pressure within the installation.

In accordance with a preferred embodiment, the aforementioned coupling means comprise a motion-reversal system with a lever of the first class as well as a coupling element having a dead range of travel and adapted to work in traction, said coupling element being interposed between the piston and a first end of said lever. The second end of said lever is adapted to cooperate with said movable member so that a tractive force exerted by the coupling element on the lever is consequently converted to a thrust force exerted on said movable member.

Preferably, the coupling means which work in traction and have a dead range of travel comprise a flexible tie interposed between the piston and the first end of the lever aforesaid.

A more complete understanding of the invention will be gained from the following detailed description and from the accompanying drawings in which a number of embodiments of the invention are illustrated by way of example without any limitation being implied, and in which.

Figure 1:
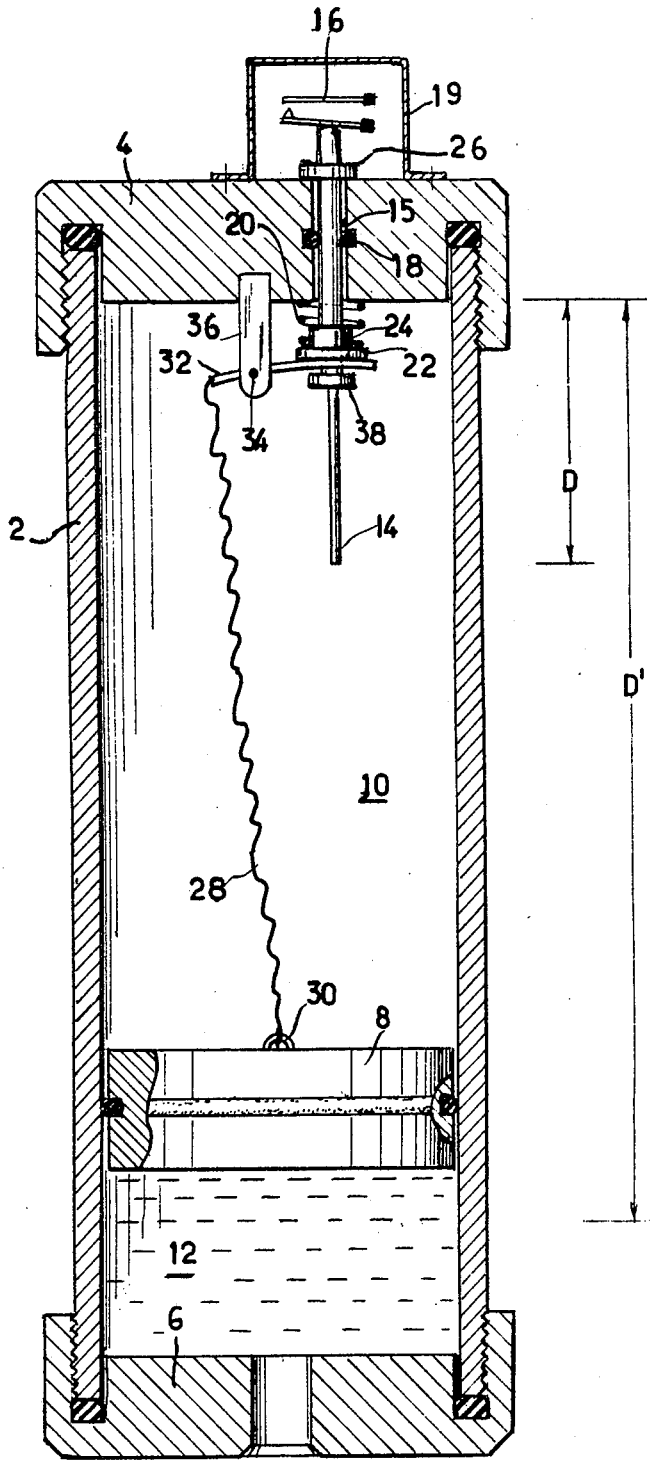
FIG. 1 is a part-sectional view of a hydropneumatic accumulator equipped with a simple gas shortage detection device of the so-called "emergent rod" type and comprising in accordance with the invention a system for checking the good operation of said device and for checking the state of pressurization or so-called inflation of the accumulator.

The hydropneumatic accumulator shown in FIG. 1 comprises in accordance with conventional practice a cylinder 2, two cylinder ends 4 and 6, a free piston 8 which divides the internal space of the cylinder into a gas compartment 10 and a liquid compartment 12. The conventional system for inflating the gas compartment has not been illustrated in the figures.

The accumulator is equipped with a simple gas shortage detection device. This device comprises a movable member constituted by a rod 14 which passes through the cylinder end 4 on the gas compartment side through a bore 15 fitted with a seal 18. The end of the rod 14 projects into the interior of the gas compartment so that, when the piston 8 comes closer to the cylinder end 4 than a predetermined distance D as a result of a shortage of gas, said piston exerts a thrust on the rod, the emergent end of which actuates a gas shortage warning system such as an electric switch 16, for example, which is mounted within a casing 19. The switch 16 is mounted in an electric alarm or warning circuit (not shown) so designed that closure of the switch 16 initiates the supply of current to an optical or sound monitoring device or to a device for automatically initiating the operation of a safety device.

A spring 20 placed around the rod 14 and applied against an annular flange 22 which is rigidly fixed to said rod prevents this latter from being thrust outwards under the action of the pressure maintained within the gas compartment whilst stops 24 and 26 serve to limit the displacements of the rod.

While this type of gas shortage detector is efficient, it has the disadvantage of calling for an additional seal for the penetration of the rod 14 through the cylinder head, this disadvantage being circumvented in other types of detector.

However, as already mentioned earlier, it is practically impossible in this instance and in the case of all other designs of the prior art to carry out a test with a view to ensuring that the detector is in good working order. The device in accordance with the present invention, however, makes it possible to perform a checking operation and also to carry out a certain number of additional tests which will be described hereinafter.

In accordance with the invention, coupling means providing reversal of motion and working in traction are interposed between the piston 8 and the movable rod 14. In the embodiment shown in FIG. 1, said coupling means comprise a flexible tie such as an inextensible cord 28, one end of which is secured to the piston 8 by means of a fastening member 30 whilst the other end is attached to a reversing lever 32. The lever 32 which constitutes a motion-reversal element is pivotally mounted at 34 on a yoke 36 which is rigidly fixed to the cylinder head 4. The end of the lever 32 opposite to the point of attachment of the cord 28 is preferably in the shape of a fork and embraces the rod 14 between the annular flange 22 and a stop 38.

The cord 28 is given a length such that said coupling system has a predetermined dead range of travel before producing action on the rod 14. In consequence, when the piston moves further away from the cylinder head 4 than a predetermined distance D', the rod 14 is also displaced in a direction which is the same as if the piston 8 were to exert a thrust on said rod, thus initiating the operation of the gas shortage warning system and making it possible to verify the correct operation of the system.

In order to carry out this checking operation, it is therefore only necessary to permit evacuation of the oil contained in the oil compartment 12 until the gas under pressure within the gas compartment causes displacement of the piston 8 up to the distance D' at which the cord 28 is tensioned and actuates the rod 14. On completion of this checking operation, it only remains to recharge the accumulator with oil by means of the pump with which the installation is normally equipped.

It is therefore apparent that the invention makes it possible to carry out a checking operation without modifying the gas cushion of the gas compartment or in other words without any need to expand or supercompress this latter to an excessive pressure.

It is important to note that, during the checking operation, all the components of the detecting device operate in the same direction and under the same conditions as in the case of an actual gas shortage operation. This gives every assurance of operational reliability of the device, especially by virtue of the fact that, in the case just mentioned, the displacement takes place under the action of a simple thrust and that there is therefore no reason why it should fail to take place in the event of a shortage of gas.

It should further be noted that the device in accordance with the invention also provides an indication in regard to the position of the free piston within the accumulator and gives warning of any excessive approach of the piston with respect to the cylinder end 6 on the oil side; such an approach would mean that the oil compartment is insufficiently filled, for example as a result of leakage, of abnormal consumption or of insufficient delivery of the recharging pump.

Finally, in the case of high-power hydraulic installations, a number of accumulators mounted in parallel are often employed as a reserve supply of hydraulic power. Up to the present time, it was very difficult to know the individual state of inflation of each accumulator. The device in accordance with the invention also makes it possible to carry out an individual checking operation of this type. In fact, it is only necessary to carry out progressive evacuation of oil from the installation and to note the pressure each time one of the gas shortage detectors has tripped. This accordingly makes it possible to determine the individual state of inflation of each accumulator.

Figure 2:
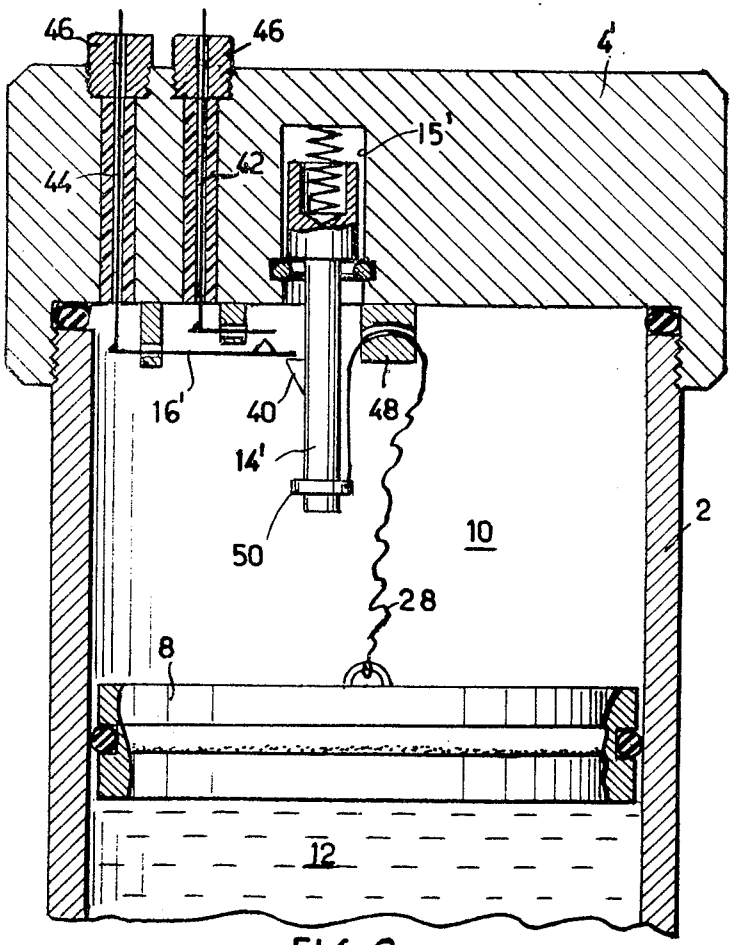
FIG. 2 is a part-sectional view of an accumulator showing an alternative embodiment of the system in accordance with the invention.

In the embodiment of FIG. 2, the gas shortage detector comprises a movable rod 14' which is slidably mounted within a blind-end bore 15' formed in the cylinder end 4' on the gas side of the accumulator and which can be actuated as a result of the thrust exerted by the piston 8 in the event of gas shortage. The rod 14' carries a lug 40 which is capable of closing a switch 16' placed within the gas compartment and adapted to control the gas shortage warning electric circuit. The conductors 42–44 connected to the switch 16 traverse the cylinder end or head 4' through packings compressed by insulating glands 46.

This arrangement has an advantage in that provision is not made for any moving seal through the cylinder head 4'. A switch 16' or a microswitch can be placed without any difficulty within the gas compartment which is filled with an inert gas such as nitrogen, for example. However, it is readily apparent that said switch could be of the magnetic proximity control type, in which case the rod 14' would carry a permanent magnet.

In the alternative embodiment which is illustrated, the motion-reversal coupling device is simply constituted by a flexible tie 28 attached to the piston 8 and passed through a reversing guide 48 which is attached to the cylinder head 4', said flexible tie being attached to the rod 14' by means of a collar 50. The operation of this embodiment for checking the state of operation of the gas shortage detection device is identical with the operation described earlier with reference to FIG. 1.

Figure 3:
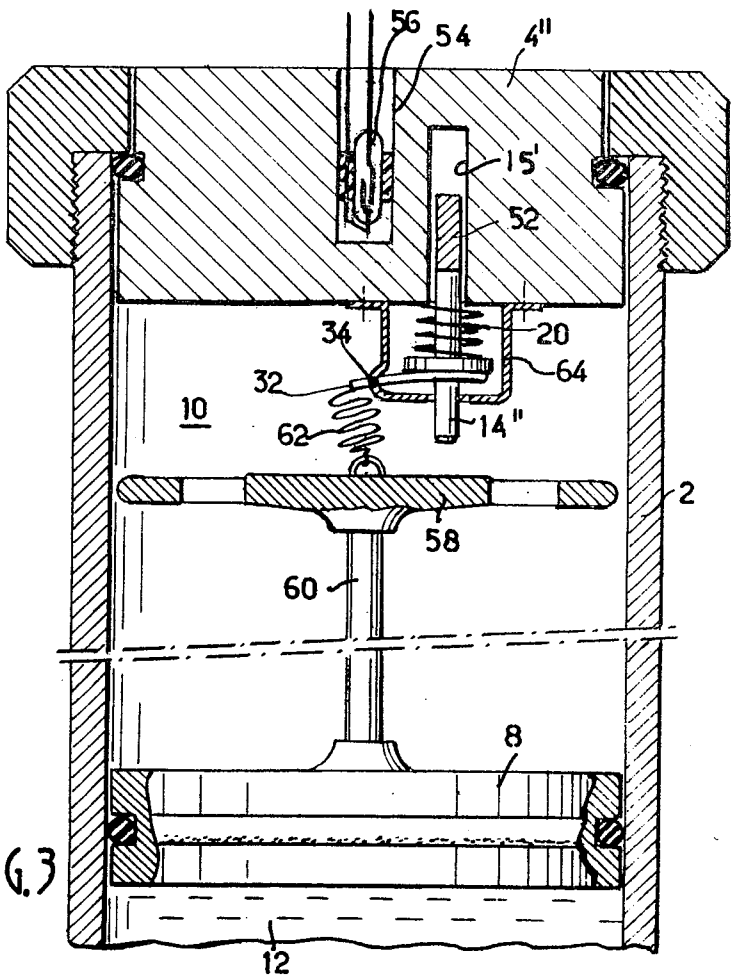
FIG. 3 is a part-sectional view of an accumulator equipped with a gas shortage detection device of the type described in the patent cited earlier and comprising a system for checking the good operation of said device.

In the preferred embodiment shown in FIG. 3, the invention is applied to an accumulator provided with a gas shortage detection system of the type described in the French patent cited earlier.

It need only be recalled that, in this detection system, the movable member against which the free piston 8 exerts a thrust is constituted by a rod 14" which is slidably mounted within a blind-end bore 15' and which carries a permanent magnet 52. Within a second blind-end bore 54 which is adjacent to the bore 15' but opens to the exterior, there is mounted a magnetic control proximity switch 56 of the type known as a reed switch or "ILS" switch. Since the cylinder head 4" is constructed of non-magnetic material, the magnet 52 actuates the switch 56 when it penetrates into the bore 15'. In this embodiment, it has been sought to limit the length of that portion of the rod 14" which projects into the gas compartment 10. To this end, the piston is caused to exert a thrust on the movable rod, not directly but through the intermediary of a component which is rigidly fixed to said piston. In the example under consideration, said component is constituted by a perforated disc 58 which is slidably mounted within the cylinder 2 and carried by a stem 60 fixed on the piston 8.

In accordance with the present invention, the tractive coupling interposed between the piston 8 (and more precisely between the disc 58) and the movable rod 14" comprises a cord 62 which actuates a lever 32 when said cord becomes taut. Said lever 32 is similar to the lever 32 shown in FIG. 1 and is pivotally mounted at 34 within a casing 64. Said casing is attached to the cylinder head 4" and houses the spring 20 which serves to restore the rod 14". At the same time, the lower end of said casing serves as a stop for the lever 32 and for the rod 14".

The operation is exactly as described in connection with FIG. 1 but it should be noted that the alternative embodiment of FIG. 3 has an advantage in that it does not entail the need for any additional seal (either a movable seal as in the case of FIG. 1 or a stationary seal as in the case of FIG. 2) through the end wall or head 4" of the accumulator.

As can readily be understood, the simple lever-type motion-reversal system shown in FIGS. 1 and 3 could be replaced by a double-lever system or by any other more complex system.

Similarly, it has been assumed in the foregoing description that the coupling element which works in traction primarily consists of a flexible tie such as an inextensible cord. It is readily apparent, however, that it would be equally possible to employ a coupling element of the telescopic type, of the folding type or even of the coiled type.

I claim:

1. A hydropneumatic piston accumulator comprising a cylinder, two cylinder ends and a free piston which divides the cylinder into a liquid compartment and a gas compartment, of the type comprising a gas shortage detection device provided with a movable member which is placed within the gas compartment and on which a thrust is exerted by the piston or a member in rigidly fixed relation thereto when said piston comes closer to the cylinder end on the gas side than a first predetermined distance, said movable member being adapted to actuate a gas shortage warning system when displaced under the action of the thrust exerted by said piston, wherein motion-reversal coupling means working in traction are interposed between said piston and said movable member, and wherein said coupling means have a dead range of travel of predetermined value so that said movable member is also displaced in the same direction as when it is displaced directly under the action thrust exerted by the piston and therefore in the direction of operation of the warning system when said piston moves away from the cylinder end on the gas side beyond a second predetermined distance.

2. An accumulator according to claim 1, wherein the coupling means aforesaid comprise a motion-reversal system with a lever and a coupling element having a dead range of travel and adapted to work in traction, said coupling element being interposed between the piston and a first end of said lever, the second end of said lever being connected with said movable member so that a tractive force exerted by the coupling element on said lever is consequently converted to a thrust force exerted on said movable member.

3. An accumulator according to claim 1, wherein the coupling means which work in traction and have a dead range of travel comprise a flexible tie.

4. An accumulator according to claim 1, wherein the warning system aforesaid comprises an electric switch which is capable of closing an electric warning circuit and wherein said movable member is mounted in operative relation with said switch.

5. An accumulator according to claim 4, wherein said movable member and said switch are placed within the gas compartment.

6. An accumulator according to claim 4, wherein the switch aforesaid is a magnetic-action switch and wherein the movable member aforesaid carries a magnet placed in operative relation with said switch.

7. An accumulator according to claim 6, wherein the magnetic-action switch aforesaid is a proximity switch of the reed type, wherein said switch is housed within a blind-end bore which opens to the exterior and is drilled in the cylinder end on the gas side, wherein said cylinder end is formed of non-magnetic material, and wherein the magnet aforesaid is slidably mounted within a second blind-end bore adjacent to the first and drilled in the cylinder end but opening into the interior of the cylinder.

* * * * *